US005533936A

United States Patent [19]

Julien et al.

[11] Patent Number: 5,533,936

[45] Date of Patent: Jul. 9, 1996

[54] SWING WITH A STABILIZER AND THE STABILIZER THEREOF

[75] Inventors: Christine E. Julien, Reading; Peter R. Tuckey, Birdsboro, both of Pa.

[73] Assignee: Graco Childrens Products, Inc., Elverson, Pa.

[21] Appl. No.: 272,348

[22] Filed: Jul. 8, 1994

[51] Int. Cl.[6] ..... A63G 9/00

[52] U.S. Cl. ..... 472/118; 297/270.2; 297/273; 5/106

[58] Field of Search ..... 472/118, 119, 472/120, 121, 122, 123, 124, 125; 297/273, 277, 270; 5/124, 127, 98.3, 106, 105; 248/370; 482/146, 147

[56] References Cited

U.S. PATENT DOCUMENTS

| | | | |
|---|---|---|---|
| 3,146,985 | 9/1964 | Grudoski . | |
| 4,150,820 | 4/1979 | Bochmann . | |
| 4,271,627 | 6/1981 | Echterling . | |
| 4,324,432 | 4/1982 | Eldon, III et al. . | |
| 4,325,578 | 4/1982 | Borucki . | |
| 4,722,521 | 2/1988 | Hyde et al. . | |
| 4,783,863 | 11/1988 | Degen | 5/106 X |
| 4,785,678 | 11/1988 | McGugan et al. . | |
| 4,805,902 | 2/1989 | Casagrande . | |
| 4,940,229 | 7/1990 | Foster . | |
| 5,322,343 | 6/1994 | Parker et al. | 297/270 X |
| 5,378,196 | 1/1995 | Pinch et al. | 472/119 |

OTHER PUBLICATIONS

1988 Product Catalog, "Graco—Baby Safe Products You Can Trust", p. 3.

*Primary Examiner*—Kien T. Nguyen
*Attorney, Agent, or Firm*—Pennie & Edmonds

[57] ABSTRACT

An infant swing assembly has a stabilizer for immobilizing the seat during placement of a child therein and removal therefrom. The stabilizer has at least one connector, preferably a pair of collinearly spaced ring connectors, for pivotally attaching to the hanger of the swing assembly. The stabilizer has an engaging portion, preferably a hook which can be engaged with the leg of the swing assembly to immobilize the seat. The stabilizer can be pivoted downward and positioned adjacent the side of the seat where the stabilizer cannot engage with the leg thus permitting the seat to freely swing and laterally outwardly where the stabilizer is able to engage with the leg.

14 Claims, 3 Drawing Sheets

SWING WITH A STABILIZER AND THE STABILIZER THEREOF

BACKGROUND

Many types of swings are available for entertaining infants. Conventional swings for small children generally include a stable, non-moving overhead structure supported by supporting legs. A hanger or hangers are swingably supported relative to the overhead structure and extend downwardly therefrom. The overhead structure can be supported by two rear supporting legs that extend downwardly from the overhead structure and two forward legs which extend downwardly from the overhead structure in a splayed relation, as disclosed for example, in U.S. Pat. Nos. 3,146,985 to Grudoski; 4,271,627 to Echterling; 4,324,432 to Eldon, III et al.; 4,325,578 to Borucki; 4,722,521 to Hyde et al; and 4,785,678 to McGugan et al. These patents generally disclose a pair of hangers attached on either side of a seat, with the upper end of the hangers pivotally or swingably attached to the overhead structure.

Similarly, the swing assembly can have two legs with a single swing arm, as disclosed, for example in U.S. Pat. Nos. 4,805,902 issued to Casagrande; and 4,940,229 to Foster.

U.S. Pat. No. 4,150,820 issued to Bochmann shows an open top swing, without an overhead structure.

A typical problem encountered in all of the above mentioned swings is that when one attempts to put a child into the seat, as the seat is designed to freely swing, the seat swings, making it inconvenient to seat the child. Similarly, when one is taking the child out of the seat, the seat swings with the child making removal also inconvenient. Thus, there is a need for a device to immobilize the seat during removal of a child from or placement of a child into the seat of the swing.

SUMMARY

The present invention is directed to an infant swing having a stabilizer and the stabilizer thereof for use with any conventional swing assembly. The swing assembly for purposes of the present invention can be any conventionally or commercially available swing assembly having any number of supporting leg or legs, a seat, an elongated hanger connected to the seat and swingably connected indirectly or directly to the leg or legs, or to an overhead structure. An infant swing stabilizer according to the present invention has an engaging portion, preferably in the form of a hook, for connecting to or engaging with one of the supporting legs or a member connected thereto, and at least one connector for operatively connecting to the seat or directly to the hanger.

The swing stabilizer according to the present invention is preferably a relatively flat, plate like member. The stabilizer preferably has longitudinally spaced ring connectors for attaching to the hanger. Preferably, the stabilizer is pivotally connected to the hanger so that it can be folded to rest next to the side of the seat during use. The stabilizer according to the present invention can also be completely disconnected from the seat or the hanger and thus from the swing assembly.

BRIEF DESCRIPTION OF THE DRAWINGS

These and other aspects and advantages of the present invention will become much more apparent from the following description and accompanying drawings.

DESCRIPTION OF THE DRAWINGS

Figure 2:
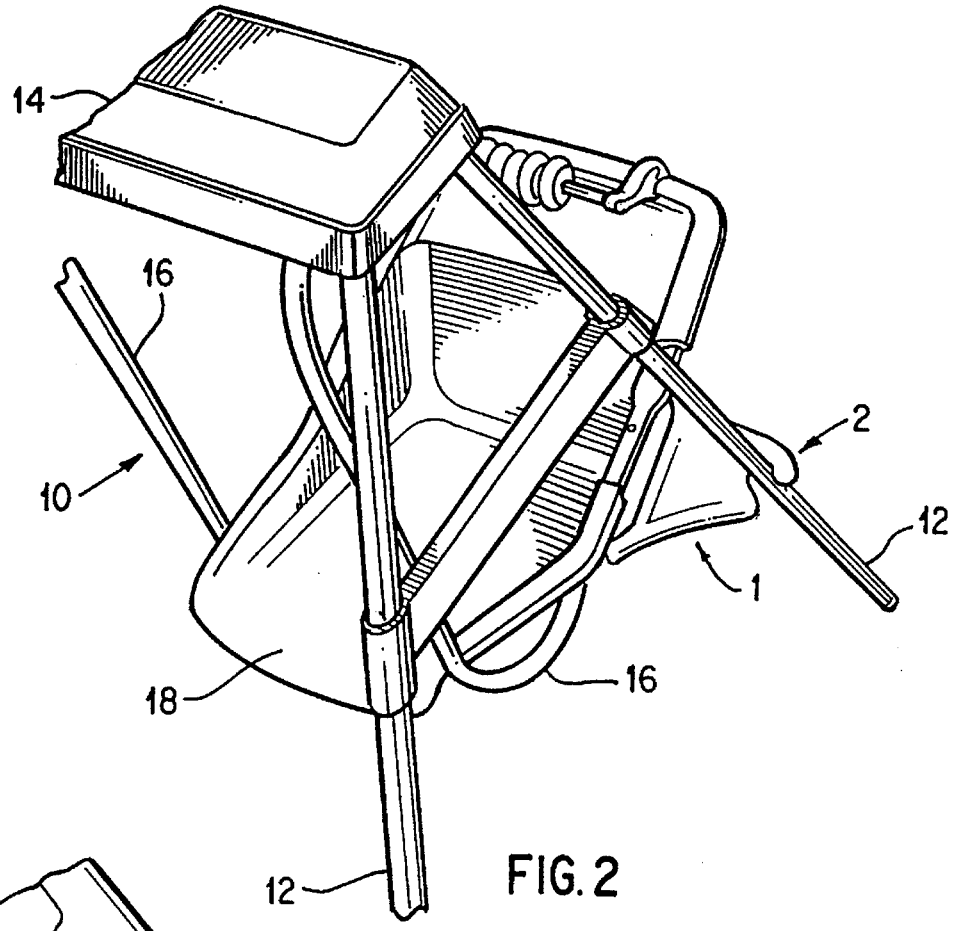
FIG. 2 is a partial perspective view of a swing with the swing stabilizer of FIG. 1 in an active position, where the stabilizer is able to connect to one of the legs to immobilize the seat.

FIG. 2 illustrates a partial view of a typical swing assembly 10, with a stabilizer 1 according to the present invention attached thereto. A complete view of the swing assembly is believed to be unnecessary since it is conventional. For purposes of illustrating the present invention, a swing assembly with four legs 12 (only two shown) connected to an overhang structure 14 is chosen. As previously indicated, any conventional swing such as shown in the above-identified prior art patents could be used with the stabilizer according to the present invention.

Figure 1:
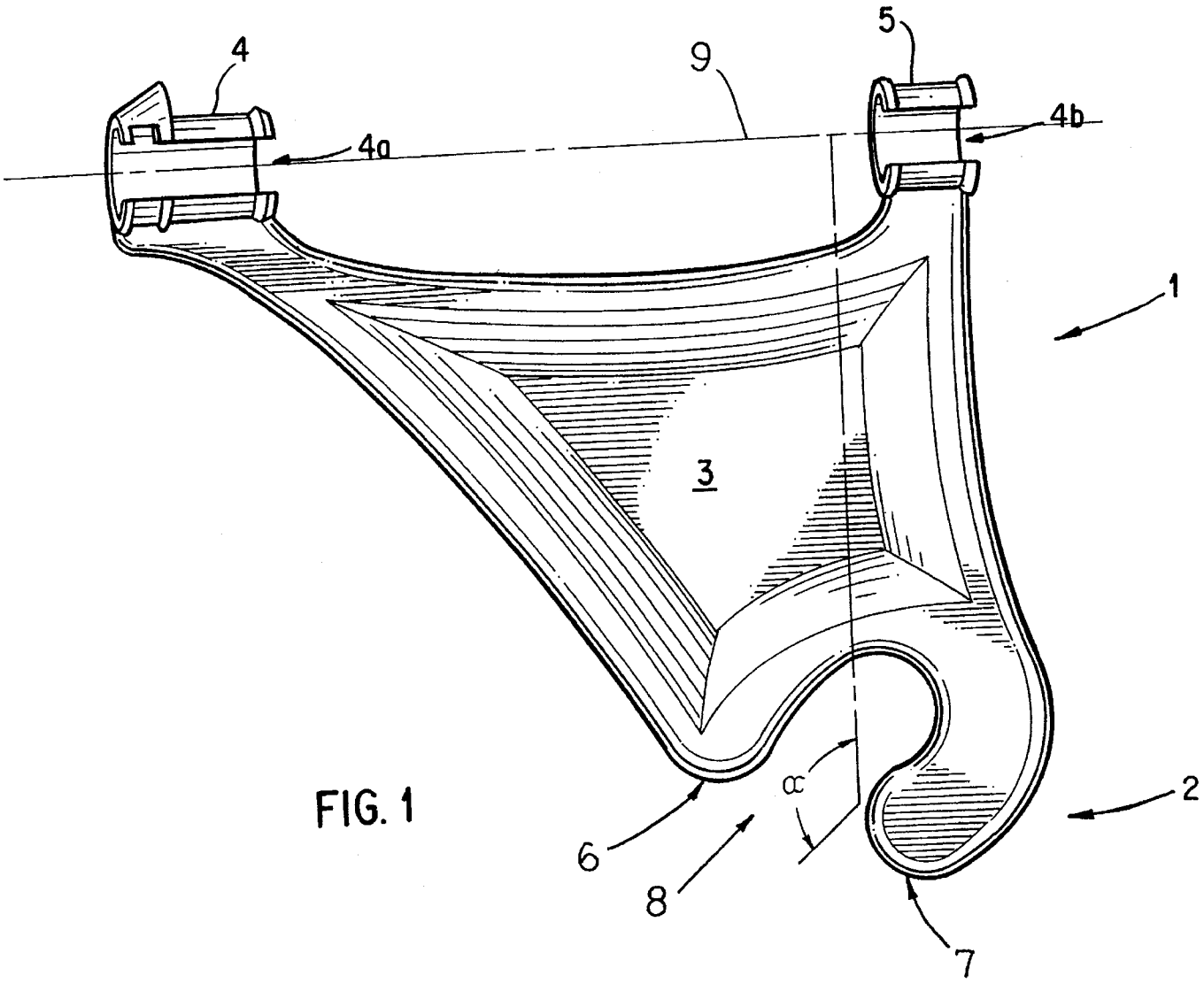
FIG. 1 is a perspective view of the swing stabilizer according to the present invention.

FIG. 1 shows the stabilizer 1 which comprises a generally flat, plate like member 3 having a hook-like engaging portion 2 and collinearly spaced ring connectors 4 and 5. While the preferred embodiment has a pair of connectors, any number of connectors can be used, including just one, so long as the connector or connectors permit a relatively secure attachment to the seat or the hanger, while permitting the stabilizer to pivot relative to the seat or the hanger. The stabilizer is preferably formed of any durable plastic material, such as polypropylene, polyethylene, nylon, polycarbonates, ABS resins, etc.

The engaging portion 2 preferably is a hook, but for purposes of the present invention, other connectors that permit the stabilizer to be attached to a supporting leg of the swing assembly can be used, such as a string, a strap, a Velcro, etc.

Each of the spaced connectors 4, 5 is preferably formed of an elastic ring type with a slot *4a*, *5a*, to permit insertion of a circular or tubular member therethrough such as a tubular hanger 16. Due to the elastic action of the ring, the ring stretches to permit insertion of the hanger through the slot and returns to its original shape to retain the stabilizer attached to the hanger.

Figure 3:
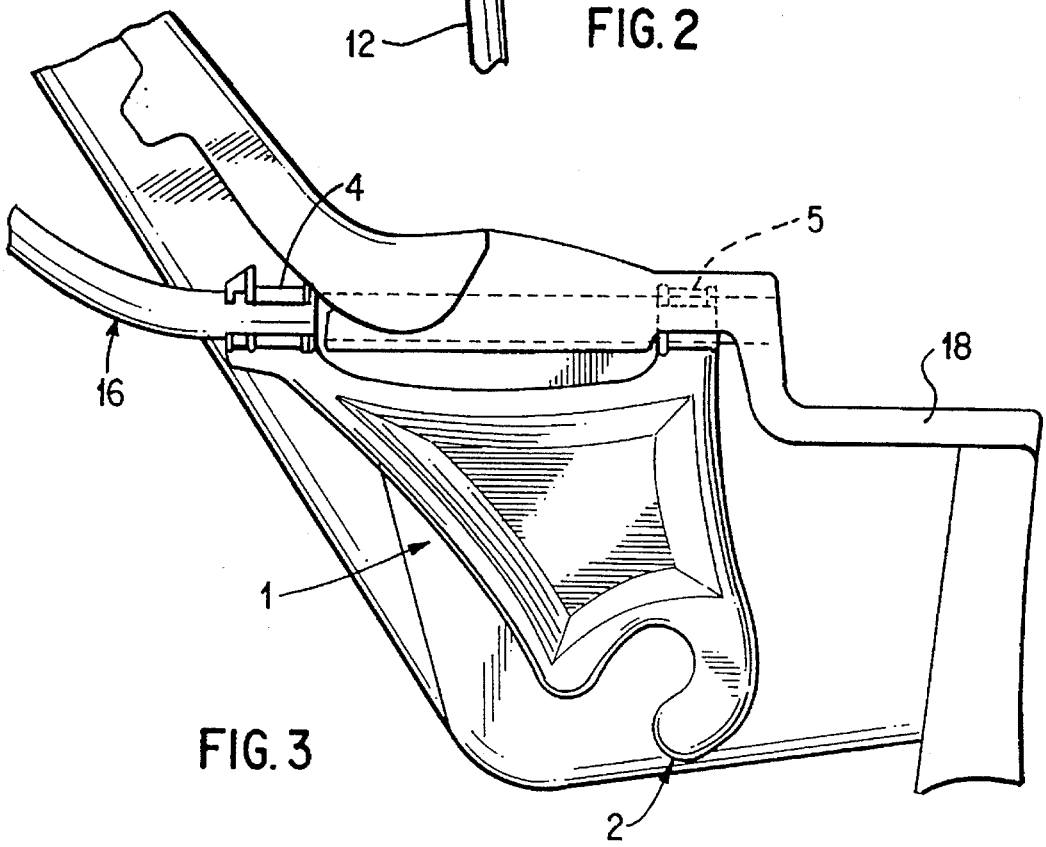
FIG. 3 is a side elevation view of the stabilizer of FIG. 2 in an inactive position, where the stabilizer is disengaged from the leg and pivoted downward and resting next to the side of the seat, allowing the seat to swing.

The unique shape of the stabilizer provides many desirable features. Specifically, the stabilizer is provided with a rounded protrusion 6 extending downwardly in front of the engaging portion opening 8 to prevent the engaging portion 2 from snagging things as the seat swings. The protrusion 6 basically serves as a deflector. The engaging portion 2 which is in a shape of a hook has a soft or rounded contour nose 7 to soften an impact. The nose is also angled $\alpha$ relative to a line drawn perpendicular to the longitudinal axis 9 of the spaced connectors to permit any item engaged thereto to automatically disengage therefrom when the swing seat is at rest and the stabilizer moved to an inactive position as shown in FIG. 3. While any angle $\alpha$ can be used so long as the engaging portion can be easily engaged and disengaged, it is preferred to have an angle $\alpha$ greater than 90°, with an angle greater than about 110° being preferred.

FIG. 2 illustrates a swing assembly having four supporting legs 12, stably connected to the overhang structure 14. A pair of elongated hangers 16 are pivotally connected to the overhang structure at one end thereof and fixedly connected at the other end thereof to either side of the seat 18. Thus, the seat can swing relative to the overhang structure.

FIG. 2 is shown with the swing stabilizer of FIG. 1 engaged in an active position, where the stabilizer is connected to a portion of the hanger and to one of the legs to thereby immobilize the seats.

FIG. 3 is a side elevation view of the stabilizer of FIG. 2 in an inactive position, where the stabilizer is disengaged from the leg and pivoted downward and resting next to the side of the seat, allowing the seat to swing. The stabilizer is connected to the hanger with two longitudinally and collinearly spaced ring connectors. In the inactive position, the stabilizer is rotated downward and is resting adjacent the side of the seat, with the engaging portion 2 tucked away so as to not interfere or touch the non-moving elements such as the legs, thus allowing the seat to freely swing. Preferably, the stabilizer should be shorter than the depth of the seat. That is, as more clearly shown in FIG. 4, the nose 7, which is at the lower most point of the stabilizer, preferably should not extend downwardly beyond the bottom 18' of the seat to prevent it from snagging any item when the seat is in motion, i.e., when the stabilizer is in the inactive position.

Figure 4:
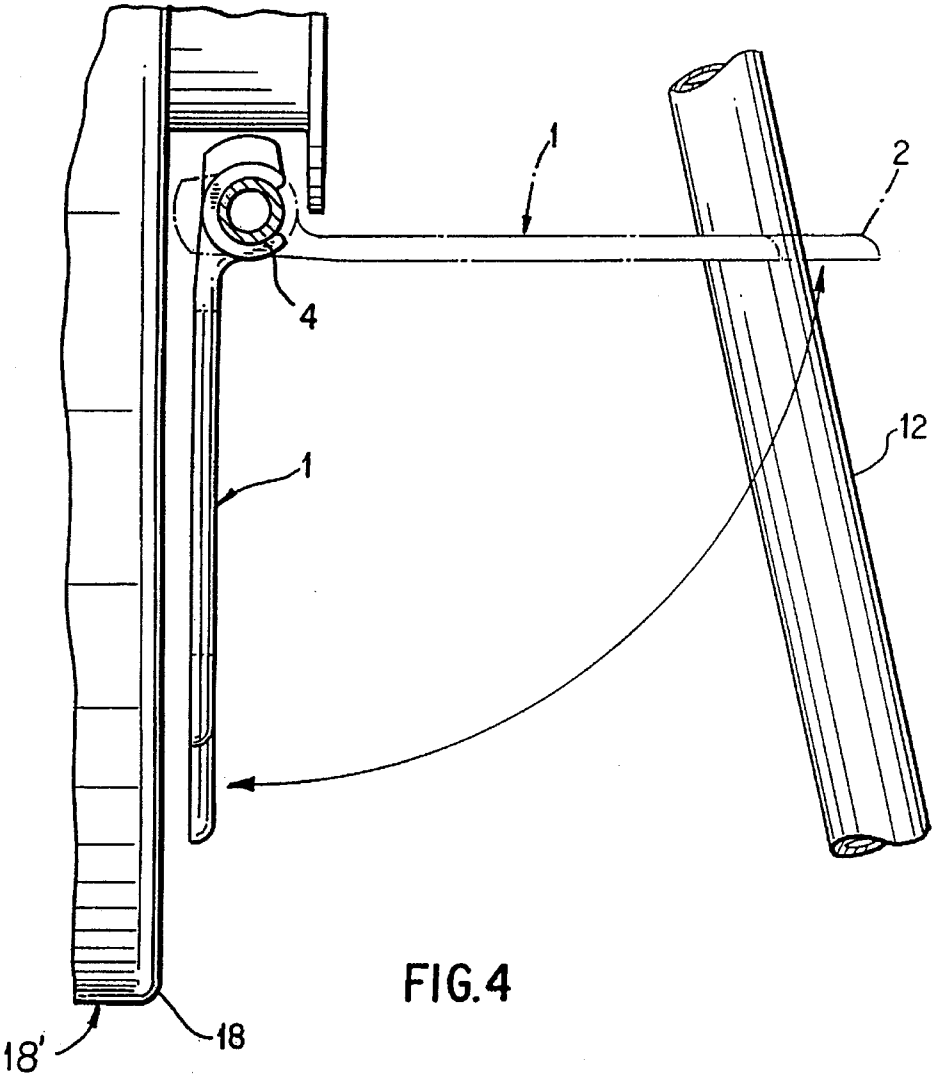
FIG. 4 is a rear elevational view of FIG. 3 showing the pivotability of the stabilizer to and from inactive to active positions, with the active position shown in phantom.

FIG. 4 is a rear elevational view of FIG. 3 showing the pivotability of the stabilizer to and from inactive to active positions, the active position shown in phantom. In the engaged or active position, the stabilizer is rotated upward so that it is extending laterally, substantially at a horizontal position, with the engaging portion engaged to one of the legs (front right). The engaging portion 2 is spaced laterally from the ring connectors so that the engaging portion automatically engages the leg on the back stroke when pivoted to the active position. It is to be noted that the stabilizer can be attached to the left side in the same manner as described above. In that event, the engaging portion will attach to the front left leg.

In the disengaged position, the stabilizer is substantially positioned parallel to the side of the seat and is unhooked from the leg. This renders the seat fully mobile and the seat free to swing.

In operation, to place a child into the seat, the seat is first moved toward the front, past the front legs. The stabilizer is then pivoted upwards to the active position. The seat can then be moved toward the back to engage the engaging portion to the leg. The child can then be placed into the seat. At this position, removal or placement of a child to/from the seat is convenient since the seat is immobilized from swinging. Furthermore, in the active position the swing is moved forward of the neutral position. As the swing is moved forward, the clearance between the overhang structure and the seat is increased. That is, a child can be placed or removed substantially vertically at this position, making removal and insertion more convenient.

After placing the child into the seat, the seat is again moved forward to disengage the engaging portion and then pivoted downward into the inactive position. The removal steps are substantially the same.

Given the disclosure of the present invention, one versed in the art would readily appreciate the fact that there can be many other embodiments and modifications that are well within the scope and spirit of the disclosure set forth herein, but not specifically depicted and described. Accordingly, all expedient modifications readily attainable by one versed in the art from the disclosure set forth herein that are within the scope and spirit of the present invention are to be included as further embodiments of the present invention. The scope of the present invention accordingly is to be limited to the extent set forth in the appended claims.

What is claimed is:

1. A swing assembly comprising:

a seat;

at least one hanger connected to said seat;

at least one leg operatively connected to said hanger to support said hanger and said seat, said hanger being swingably connected relative to said leg; and a stabilizer having at least one connector operatively connected to said seat, and an engaging portion for connecting to said leg to immobilize said seat, wherein said connector enables said stabilizer to move relative to said seat between an active position where said engaging portion is able to connect to said leg, and an inactive position where said engaging portion is unable to connect to said leg.

2. A swing according to claim 1, wherein at least two supporting legs support said hanger and said seat.

3. A swing according to claim 2, wherein four supporting legs support said hanger and said seat.

4. A swing according to claim 3, further comprising an overhead structure connected to said legs and said hanger is pivotally connected to said overhead structure.

5. A swing according to claim 4, wherein a pair of hangers support said seat, said hangers being pivotally connected to said overhead structure.

6. A swing according to claim 1, wherein said stabilizer comprises a flat plate like member, wherein said engaging portion is a hook for connecting to said leg.

7. A swing according to claim 6, wherein said plate like member further comprises a pair of collinearly spaced flexible ring connectors.

8. A swing according to claim 7, wherein said ring connectors are connected to said hanger, each of said ring connectors having a slot to permit insertion of said hanger therethrough.

9. A swing according to claim 8, wherein said stabilizer is substantially parallel and adjacent to a side of said seat and above a bottom of said seat when said stabilizer is in said inactive position.

10. A swing stabilizer for use with a swing assembly having at least one supporting leg, at least one swinging hanger operatively connected to said leg at one end, and a seat connected to said hanger at the other end, comprising:

a pair of collinearly spaced ring connectors adapted to wrap around said hanger; and an engaging portion for connecting to said leg, wherein said ring connectors enable said stabilizer to move between an active position where said engaging portion is able to connect to said leg, and an inactive position where said engaging portion is unable to connect to said leg.

11. A stabilizer according to claim 10, wherein said engaging portion is a hook for connecting to said leg.

12. A stabilizer according to claim 10, wherein said ring connectors are flexible, and, each of said ring connectors having a slot to permit insertion of said hanger therethrough.

13. A method of loading or unloading a child from a swing assembly having a seat; at least one hanger connected to said seat; at least one leg operatively connected to said hanger to support said hanger and said seat, said hanger being swingably connected relative to said leg; and a stabilizer having at least one connector operatively connected to said seat, and an engaging portion for connecting to said leg to immobilize said seat, wherein said connector enables said stabilizer to move relative to said seat between an active position where said engaging portion is able to connect to said leg, and an inactive position where said engaging portion is unable to connect to said leg, comprising the steps of:

moving said seat forward past said leg;

pivoting said stabilizer upwards until said stabilizer is substantially in a horizontal position;

moving said seat toward its neutral position;

engaging said engaging portion with said leg while returning said seat toward its neutral position to thereby immobilize said seat; and loading or unloading the child.

14. A method according to claim 13, further comprising the steps of:

after loading or unloading the child, moving the seat forward to disengage said engaging portion from said leg; and pivoting said stabilizer downward so that said stabilizer can no longer engage with said leg.

* * * * *